United States Patent [19]

Zeiss

[11] Patent Number: 4,839,636

[45] Date of Patent: Jun. 13, 1989

[54] CONTROL OF DISPLAY HAVING BOTH DOT-MATRIX AND SEGMENT DISPLAY ELEMENTS

[75] Inventor: Manfred Zeiss, Rüsselsheim, Fed. Rep. of Germany

[73] Assignee: VDO Adolf Schindling AG, Frankfurt am Main, Fed. Rep. of Germany

[21] Appl. No.: 776,946

[22] Filed: Sep. 17, 1985

[30] Foreign Application Priority Data

Sep. 17, 1984 [DE] Fed. Rep. of Germany ..... 3434118

[51] Int. Cl.[4] ..... G09G 3/00

[52] U.S. Cl. ..... 340/752; 340/756; 340/765; 340/784; 340/799

[58] Field of Search ..... 340/752, 790, 794, 814, 340/799, 716, 756, 765, 784; 350/374

[56] References Cited

U.S. PATENT DOCUMENTS

| | | | |
|---|---|---|---|
| 4,270,846 | 6/1981 | Miyamato | 350/374 |
| 4,465,999 | 8/1984 | Tsuzuki et al. | 340/756 |
| 4,504,829 | 3/1985 | Usui | 340/752 |
| 4,692,760 | 9/1987 | Unno et al. | 340/756 |

FOREIGN PATENT DOCUMENTS

| | | | |
|---|---|---|---|
| 2125588 | 3/1984 | United Kingdom | 340/756 |

*Primary Examiner*—Gerald L. Brigance
*Attorney, Agent, or Firm*—Martin A. Farber

[57] ABSTRACT

A device for controlling an opto-electronic display device has dot-matrix display elements (15), a controller (10) which has an addressable dot-matrix character table (addresses 20–35; 36–41 as well as 45 (in part), 46 and 47), a program control device as character generator and at least one driver (19). Information can be displayed in dot-matrix form. In order to display, in parallel, other information in a segment display, the addressable dot-matrix character table has an additional, similarly addressable and structured table part (addresses 20–35 as well as 42–44 and 45 (in part)), in which, instead of dot-matrix data, segment data containing the segment character set are stored in a code which is constructed according to segment connections (electrode connections S1–S3; Z1–Z5). The character table (17) which has been expanded in this manner can be controlled by the expanded program control device and is connected via the driver (19), adapted to the segment display elements, with the dot-matrix display elements (15) and with the segment display elements (11–14).

4 Claims, 4 Drawing Sheets

Figure 1:
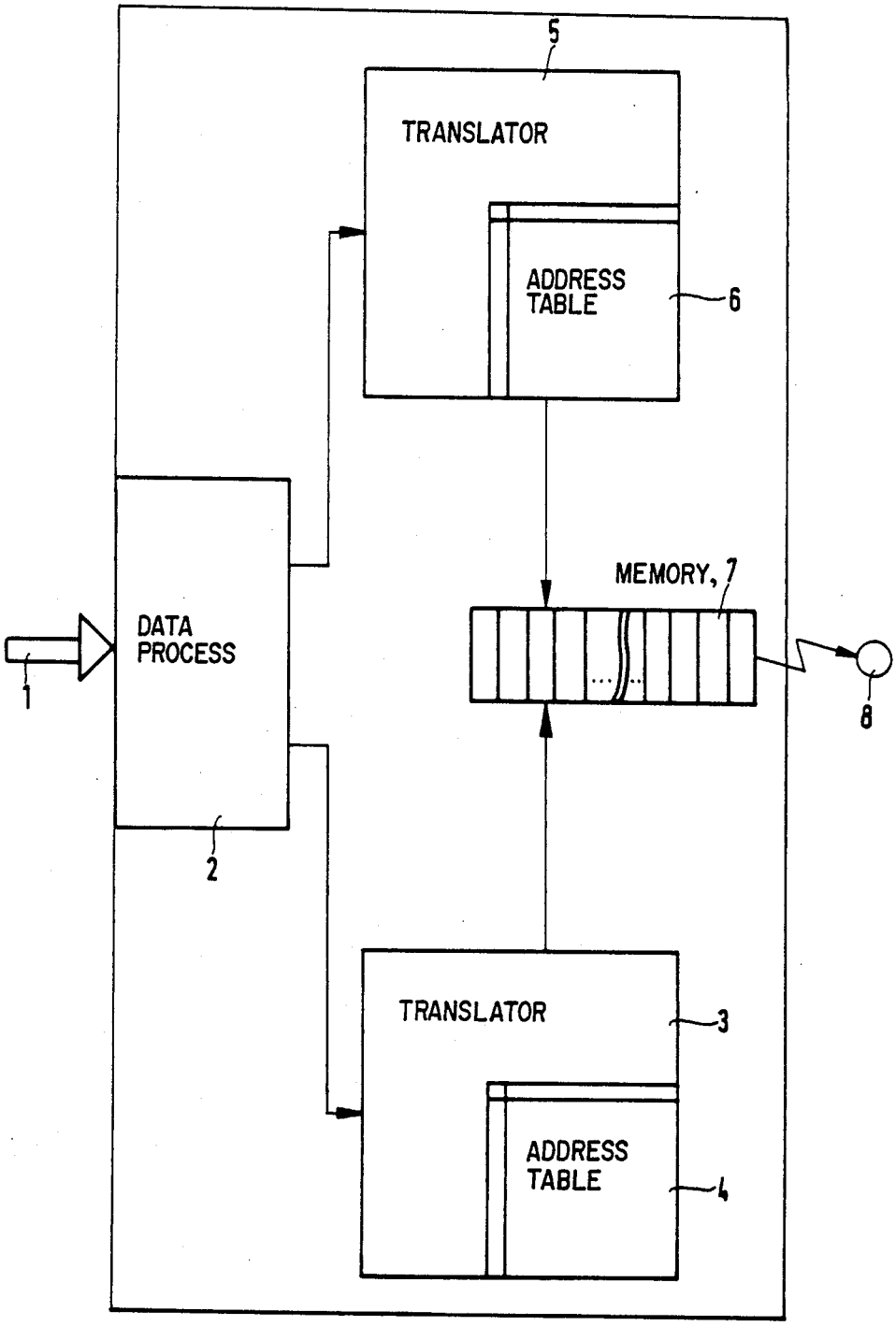

| | 1 | 2 | 3 | 4 | 5 |
|---|---|---|---|---|---|
| 1 | 0 | 0 | 0 | 0 | 0 |
| 2 | 0 | 0 | 1 | 0 | 0 |
| 3 | 0 | 1 | 0 | 0 | 0 |
| 4 | 1 | 0 | 0 | 0 | 0 |
| 5 | 0 | 1 | 0 | 0 | 0 |
| 6 | 0 | 0 | 0 | 0 | 0 |
| 7 | 0 | 0 | 0 | 0 | 0 |

CONTROL OF DISPLAY HAVING BOTH DOT-MATRIX AND SEGMENT DISPLAY ELEMENTS

BACKGROUND AND FIELD OF THE INVENTION

The present invention relates to a device for controlling an opto-electronic display device which has dot-matrix-display elements, a controller including an addressable dot-matrix character table with a program-control device as character generator, and at least one driver of the display elements.

The invention, furthermore, relates to a method of controlling such as opto-electronic disiplay device.

Alpha-numeric characters can be reproduced in dot-matrix or segment display. Both methods of display have basic advantages, depending on the nature of the alpha-numeric characters to be represented, legibility and other criteria. Therefore, it may be desirable to display a first group of data, referred to hereinbelow as input data, by a dot-matrix display, and a second group of data (input data) by a segment display. For example, the first group of input data may contain date information, such as the days of the week, while the second group of data may contain time information, such as the hour of the day.

Liquid-crystal display elements are particularly suitable for display in segment representation. However, vacuum fluorescence display elements and other opto-electronic display elements also enter into consideration.

In one known device of the aforementioned type for controlling an opto-electronic display device with dot-matrix display elements, an essential element is a controller which comprises a character generator as well as a driver which acts on the display elements. The character generator contains specifically a character table in which the set of characters to be displayed is stored in addressable fashion. In the character table in which the characters to be shown in dot-matrix display elements are stored, each storage place contains one matrix dot of the character to be displayed. Corresponding to the input data which are coded for the addressing of the character table the dot-matrix data are read out of the character table, controlled by a program control for each character to be shown and fed via the driver to the dot-matrix display elements. The dot-matrix display elements can be controlled for a 5×7 dot matrix with a multiple rate of 1:7 in time-division mode. For the display of characters by the segment display elements, on the other hand, a different method of control is used in the prior art: For this purpose, the input data, which in the present case are the input data of the second group are so re-coded by a program that the segments for each dot-matrix display element are controlled in a manner corresponding to the alpha-numeric characters to be displayed. In this connection, the dot-matrix display elements may be acted on by a driver in time-division mode, to which there ordinarily corresponds a multiplex rate of 1:3, since one back electrode can be associated with three front electrodes. Upon re-coding of the input data, therefore, the program must be able to convert the entire set of alpha-numeric characters into a large number of segment data which are to be transferred into the controller, i.e. the driver. If, therefore, it is desired to use dot-matrix and segment representations alongside of each other, then the formation of the segment data and the formation of the matrix-dot data from the input data are effected in fundamentally different ways. This results in a high expense as well as in additional operating disadvantages, particularly in connection with the transfer of the re-coded data. The ordinarily different multiplex rates with which dot-matrix display elements and segment display elements are operated have the disturbing result, visible from the outside, that the two displays are of different contrast.

SUMMARY OF THE INVENTION

The object of the present invention is to improve the processing of the re-coded input data for the parallel, practically simultaneous display of alpha-numeric characters by dot-matrix display elements and segment display elements and, in particular, to reduce the technical expense for this, simplify the transfer of the re-coded input data, and create the necessary condition so that the alpha-numeric characters show the same contrast in dot-matrix representation and in segment representation.

According to the invention the control of the adjacently arranged segment display elements (11–14), preferably of a liquid-crystal display, the addressable dot-matrix character table (addresses 20–35; 36–41 as well as 45 (in part), 46 and 47) is expanded table part (addresses 20–35 as well as 42–44 and 45 (in part) to form a character table (17) in which, instead of dot-matrix data, segment data containing the segment character set are stored in a code developed in accordance with segment connections (S1–S3 and Z1–Z5) of the segment display elements (11-14); that the expanded character table (17) can be controlled by the program-control device which is expanded for this and that it is connected, via the driver (19) adapted to the segment display elements (11–14), with the dot-matrix display elements as well as the segment display elements.

The essence of the invention provides that, in order to control the dot-matrix display elements and the segment display elements, instead of using two different principles and systems, one starts with a single dot-matrix controller which is so modified that it can also be used to control the segment display elements. A separate program for forming the segment data is therefore unnecessary. The segment data are produced in fundamentally the same manner as the dot-matrix data. The expansion of the character table which is contemplated for this requires only a slight additional expense, particularly since substantially the same program control can be used for operating the controller which contains the character table. For this it is necessary that the part of the character table which is to contain the segment data corresponding to the set of segment characters be programmable. For this purpose, use may be made, in general, of ROMs and particularly PROMs or EPROMs. Both the segment data and the dot-matrix data are fed to the display device via the same driver, which is developed for the driving of the segment display elements. In this connection, the same high multiplex rate of, for instance, 1:7 (and higher) can be used with the program control for the segment display as is customarily used for the dot-matrix display. Thus, the dot-matrix display elements and the segment display elements can be conveniently read with the same contrast. It is particularly advantageous that the controlling or addressing of the controller having the character table can take place by means of input data recoded in the same manner for the dot-matrix display and the segment display. These data can thus be transferred by a uniform data telegram which contains the re-coded input data of both the first group and the second group. Expensive measures for the parallel transfer of these data of the first and second groups are done away with, as well as expensive means for the separating of the data.

In particular, a feature of the invention relates to an input memory (16) which is disposed in the controller (10) and is adapted to receive a data telegram by which both selected dot-matrix data and segment data can be addressed. Therein the data telegram for both the dot-matrix display elements and the segment display elements can be fed into an input memory of the controller. The data can be read serially from the latter and displayed with the dot-matrix display elements and the segment display elements associated with each other in the manner intended. These elements are activated in synchronism wtih the associated segment data and matrix-dot data read from the character matrix.

The expanded character table for the segment data in accordance with the invention causes a change in the address management as compared with the normal dot-matrix character table. For example, the storage places for the segment data can be addressed with addresses which have an identical component (for instances, lower bits) as for the addressing of the dot-matrix data and, in addition, have another component (higher bits). The storage elements of the data table each of which is associated with a character contain, for the controlling of the segment display elements, the segment data associated with the electrodes for the activating of the segments which can be controlled columnwise and linewise. For this purpose, fewer storage elements are occupied than for controlling a $5\times7$ dot matrix.

Further features of the invention are directed to process aspects of the invention for controlling the opto-electronic display device of the foregoing type when it is desired also to display segment display elements in parallel therein. These features are in a method of controlling an opto-electronic display device which has dot-matrix display elements which display a first group of input data which are converted into a form suitable for controlling a character generator with an addressable character table, are processed in the character generator, outputted from the dot-matrix data and stored, intensified, in the dot-matrix display elements, characterized by the fact that for the parallel display of a second group of input data by means of segment display elements (11–14) in the expanded character table (17) of the character generator alongside the dot-matrix data, segment data containing the segment character set are stored in a code associated with segment connections (electrode connections S1–S3; Z1–Z5) of the segment display elements, the input data of the second group are converted into a code suitable for addressing the segment data (for addressing the lines 20–35 and columns 42–44 and 44 and 45 (in part) in FIG. 3), the addressed segment data are processed in the character generator to form segment signals, intensified and fed, synchronized, for the activating of the segment display elements to the latter.

Further features are characterized by the fact that the input data of the first group, converted for the addressing of the character generator (expanded character table 17), and of the second group are combined in a data telegram (in the output storage 7) and transferred to the character generator, and that the activating of the dot-matrix display elements (11–14) and of the segment display elements (15) is synchronized with the data telegram. Parallel display means that both segment display elements and dot-matrix display elements can be read simultaneously. The controlling of these display elements is effected, however, serially with a high frequency of repetition. The input data are re-coded for this in fundamentally the same manner for the formation of address data to which the character table for the character generator responds. In this way, the dot-matrix data and the segment data are read in the sequence of the address data from the character table, processed in the character generator and fed, amplified via the driver, to the display elements. The same processes, therefore, take place both for the segment display and the dot-matrix display, as a result of which the expense for carrying out the method is slight and the reliability of operation high.

The associating of the address data for the segment data and for the dot-matrix data which are trasmitted by the telegram with the display element is effected in less expensive fashion such that the data telegram—which if necessary has been provisionally stored—is read into the address part of the character table synchronously with the activating of the display elements and processed in the character generator.

Figure 2:
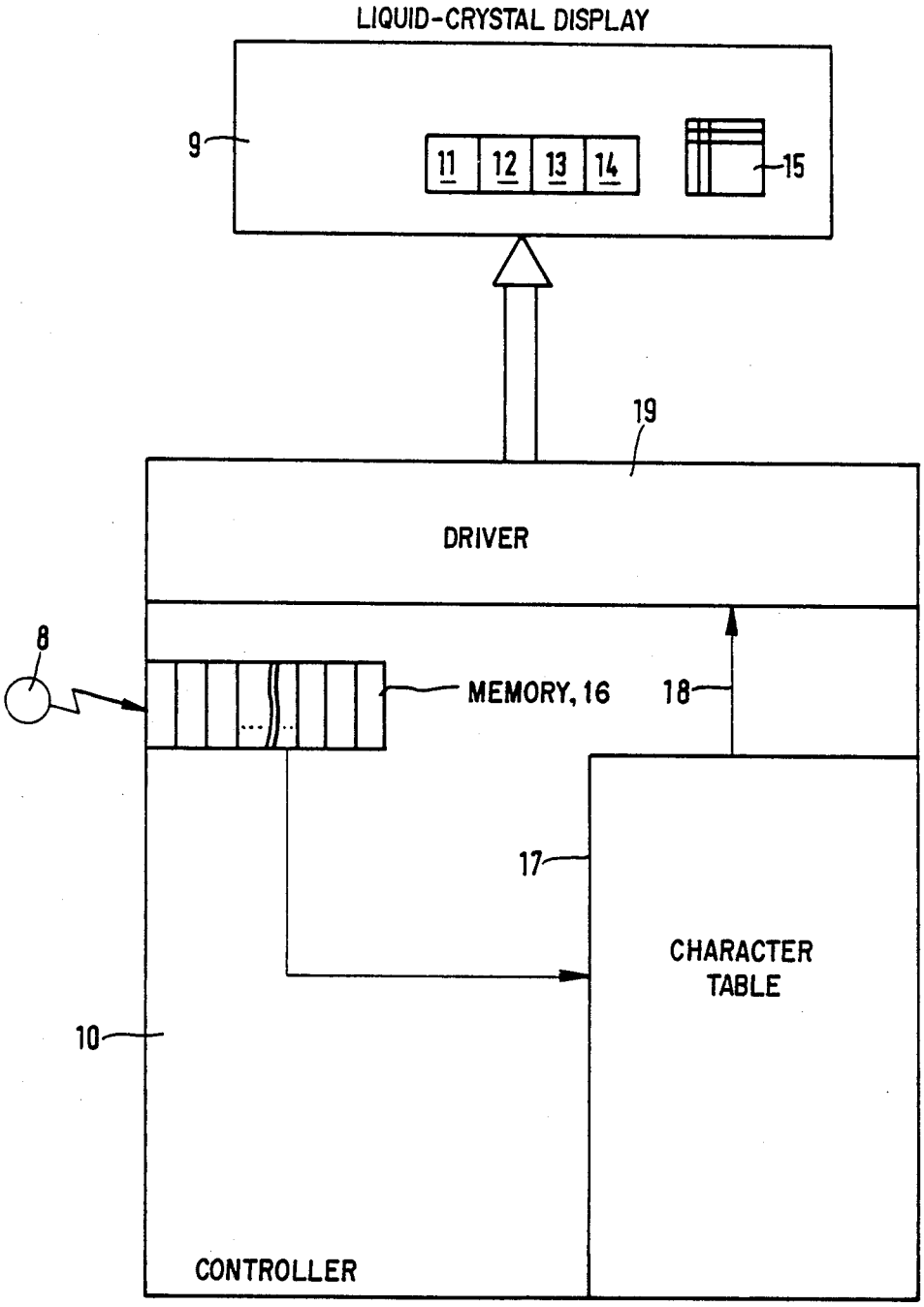
Figure 3:
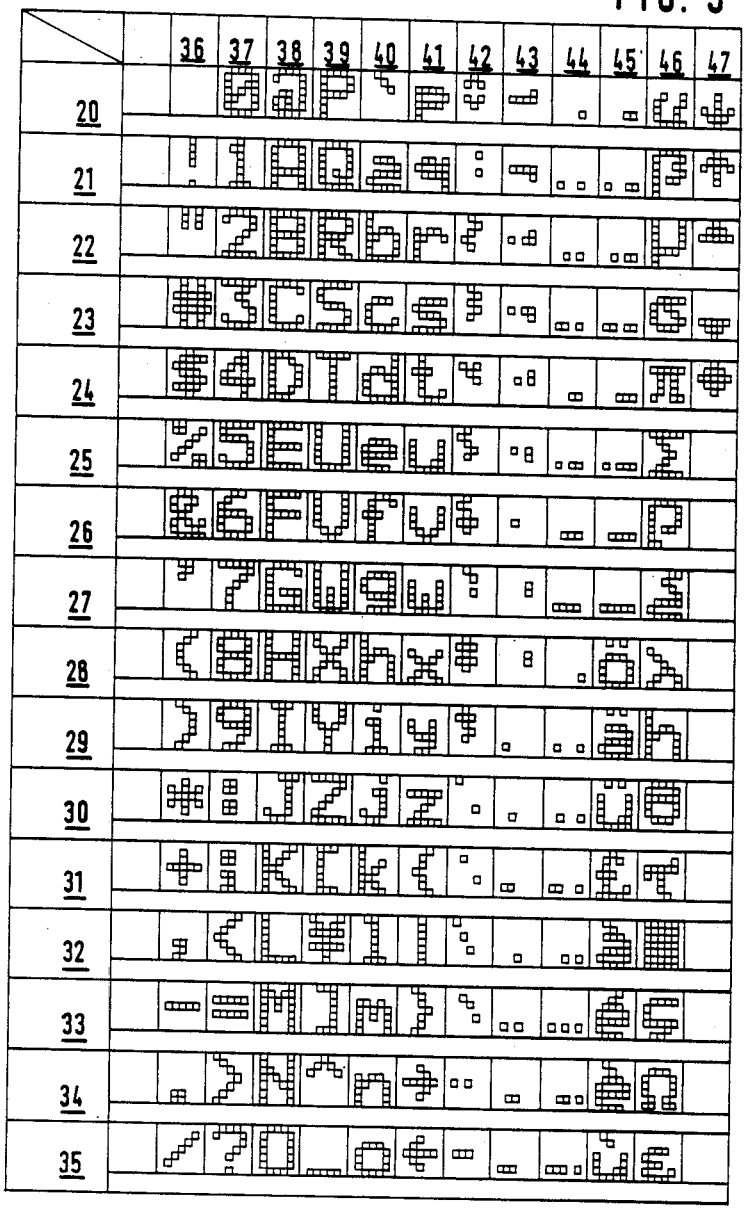
Figures 4, 5:
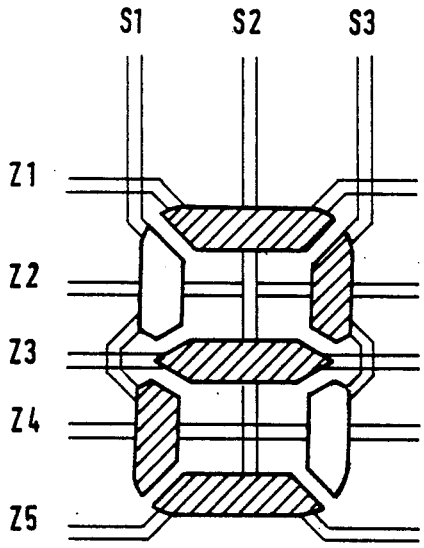

The invention will be explained below with reference to the five figures of the accompanying drawing, in which:

FIG. 1 is a block diagram of the general data processing of input data to be displayed, including the means for forming a data telegram by which a controller for the controlling of a display can be addressed, FIG. 2 shows the controller and the display, also in the form of greatly simplified block diagram, FIG. 3 shows a character table of the controller, FIG. 4 shows a portion of the additional part of the character table in which segment data for a character are stored, and FIG. 5 shows a segment display element, associated with the region in FIG. 4, together with its connections.

In FIG. 1, is an input for the feeding of so-called input data which are to be displayed into a general data processing system 2. The input data may consist, for instance, of binary coded data of a digital time module and in such case contain time information which is to be displayed in segment display as well as date information which is to be made visible by dot-matrix display. The general data-processing system may contain an organization for the reading-in of the data, for the identifying of the data, for the processing of the data, for the classifying of the data on basis of the type of display—segment or dot-matrix—and be of conventional construction. From the time information, the clock time, which is to be shown in binary fashion, is formed, for instance, by the ingetrating of time pulses. From the date information, the present day of the week is derived. Within the scope of the present operation, the input data containing the date information which are to be displayed in dot-matrix display, are referred to as input data of the first group and the input data of the time information which are to be displayed in segment display are referred to as input data of the second group.

The translator 3 for the processed data for the first group is connected to the general data processing system 2. The translator 3 contains an address table 4 for the character set to be indicated in dot-matrix display. By the translator 3, the code of the processed input data of the first group is so translated that a controller which is to be spoken to—FIG. 2—can be addressed with the data. For this purpose, the translated data for the first group pass into an output memory 7 in which a data telegram is compiled.

The code of the processed input data of the second group is advantageously translated by means of a translator 5 in fundamentally the same manner for the addressing of the controller in FIG. 2 as the processed input data of the first group. For this purpose, the translator 5 contains an address table 6 for the character set in segment representation which is contained in the controller. By means of the translator 5, therefore, an address is selected from the address table 6 which corresponds to processed check-time information so as to display the clock time with the following means in the usual decimal representation. For this purpose, the addresses which are formed from the first group of input data and the addresses which are produced from the second group of input data are combined in a data telegram in the output memory 7.

The showing of FIG. 2 adjoins the interface 8 and comprises essentially a liquid-crystal display (LCD) 9 as well as a controller, designated generally as 10, for the operation of the display.

The LCD display has four segment display elements 11–14 for the displaying of the clock time. In order to show the day of the week, the dot-matrix display element 15 is used.

The controller comprises, in detail, an input memory 16 to receive the data telegram containing addresses for the dot-matrix data to be selected for the day of the week to be displayed and addresses for the segment data to be selected for the displaying of the present clock time by means of the LCD display device 9.

The set of dot-matrix data for the characters which are possible in dot-matrix display is contained in a dot-matrix character table which, to this extent, is conventional and forms an essential part of the character table 17. The dot-matrix character table is supplemented by an additional, similarly addressable and structured table part containing the segments which form the displayable segment character set. Details of the character table 17 can be noted from FIG. 3, which is described below. First of all, it may be pointed out that the character table 17 together with a program control (not shown) forms a character generator which produces, at an output channel 18, signals which, by means of the display elements 11–15 activated at the time, make visible the alpha-numeric characters to be displayed. For this purpose, the signals on the output channel 18 are amplified in a driver 19 which also forms part of the controller 10. In the character table of FIG. 3, the data for representing a set of alpha-numeric characters are contained in regions which are organized in matrix fashion along lines 20–35 and columns 36–47. In accordance with the present definition, therefore, one region having seven memory elements (corresponding to lines to be controlled) and five stored items of information each (corresponding to columns to be controlled) corresponds to each alpha-numeric character; see FIG. 4. Each of the storage regions of the character table is addressable by a character word which is composed of the addresses 36–47 and 20–35.

The character table shown in FIG. 3 is provided in conventional manner with matrix-dot data with respect to the storage regions which can be addressed by the addresses 36–41 as well 45 (in part), 46 and 47. This part of the character table is also known as the matrix-dot character table. The additional part of the character table comprises columns of memory regions which can be addressed under the reference numbers 42, 44 and 45 (in part), and in each of which segment data of an alphanumeric character are programmed. At least this additional part must therefore be programmable.

The coding of the segment data in a memory region is shown in FIG. 4, referred to a segment display element in FIG. 5, which, in customary arrangement, has seven segments. The segment display element in FIG. 5 has column-electrode connections S1, S2 and S3 as well as line-electrode connections Z1, Z2, Z3, Z4 and Z5. In order to represent the character "2" the following pairs of electrodes, for example, must be placed under voltage: S1, Z4; S2, Z1; S2, Z3; S2, Z5; S3, Z2; the segment data corresponding hereto result analogously from the region of the additional table part shown in FIG. 4. In this connection, the "1" means segment activated; and the "0" means segment not activated.

FIG. 4 therefore shows the coded information of the segment data for the representation of a "2".

A data telegram in the input memory 16 which contains the addresses for the display of the information of the first group of input data and for the display of the second group of input data is processed essentially as follows: The adresses are read serially from the input memory and, synchronously with this, the display elements 11–15 are activated, i.e. prepared for display. For each address word therefore one display element becomes active. One of the storage regions of the character table in FIG. 3 which are addressable in matrix fashion is called up by the specific address word called for. The dot-matrix data reached for each alphanumeric character in dot-matrix representation under an address are translated in conventional manner by the time program control into dot-matrix signals by which the dot-matrix display element 15 can be controlled with a multiplex rate of, for instance, 1:7. Thus, the alphanumeric characters "Mo" for "Monday" appear in the dot-matrix display element 15.

The decimal numbers for showing the clock time with the segment display elements 11–14 are produced in the manner that for each decimal digit, one region of the additional part of the table is acted on under one of the addresses 42–44 combined with one of the addresses 20–35. For each region then the segment data shown, for instance in FIG. 4, are read out and converted into signals which, via the driver 19, connect the corresponding pairs of electrodes to voltage; see FIG. 5. This action on the electrodes takes place also in multiplex mode with the same multiplex rate as for the operation of the dot-matrix display element 15, so that the clock time, 12:30 o'clock in the example, and the day of the week, Mo in the example, are offered as a single pictorial display.

I claim:

1. A system for controlling an opto-electronic display device, such as a liquid crystal display, having both dot-matrix display elements and segment display elements, the system comprising a controller including an addressable dot-matrix character table for generation of characters, and a driver of the dot-matrix display elements and the segment display elements; and wherein The addressable dot-matrix character table stores character sets of both dot-matrix data and segment data; and wherein the segment data are stored in a code corresponding to segment connections of segment display elements, the character table being connected, via the driver, with the dot-matrix display elements and the segment display elements.

2. the system according to claim 1, wherein said controller further comprises an input memory for receiving data signals by which both selected dot-matrix and segment character sets can be addressed.

3. A method of controlling an opto-electronic display device comprising dot-matrix display elements which display a first group of input data, and segment display elements which display a second group of input data; the method comprising steps of converting the input data of each group into corresponding character address signals suitable for controlling a character generator, said character generator comprising an addressable character table formed of two portions wherein a first and a second of the two portions respectively have a first character set for operation of the dot-matrix display elements and a second character set for operation of the segment display elements;

applying the character address signals corresponding to said first group and said second group of input data to the character generator for addressing the two portions of the character table to activate the dot-matrix and segment display elements respectively.

4. The method according to claim 3, further comprising a step, prior to said applying step, of combining the character address signals corresponding to the first group and to the second group of input data in a common data stream.

* * * * *